United States Patent [19]

Crankshaw et al.

[11] Patent Number: 4,844,771

[45] Date of Patent: Jul. 4, 1989

[54] PRINTER-TAMP LABEL APPLICATOR

[75] Inventors: Michael Crankshaw, Santa Fe Springs; Arthur B. Newell, Santa Ana, both of Calif.

[73] Assignee: Label-Aire Inc., Fullerton, Calif.

[21] Appl. No.: 109,724

[22] Filed: Oct. 16, 1987

[51] Int. Cl.[4] ..... B65C 9/18; B65C 9/28

[52] U.S. Cl. ..... 156/387; 156/249; 156/542; 156/DIG. 33

[58] Field of Search ..... 156/361, 540, 541, 542, 156/249, 556, 580, 384, 387, DIG. 1, DIG. 2, DIG. 9, DIG. 10, DIG. 25, DIG. 33, DIG. 42; 226/158, 160, 167; 221/23

[56] References Cited

U.S. PATENT DOCUMENTS

| | | | |
|---|---|---|---|
| 4,132,583 | 1/1979 | Hodgson | 156/DIG. 42 |
| 4,210,484 | 7/1980 | Crankshaw et al. . | |
| 4,255,220 | 3/1981 | Kucheck et al. | 156/249 |
| 4,255,229 | 3/1981 | Kucheck et al. . | |
| 4,321,103 | 3/1982 | Lindstrom et al. | 156/363 |
| 4,337,108 | 6/1982 | Crankshaw et al. . | |
| 4,390,386 | 6/1983 | Bartl | 156/542 |
| 4,612,079 | 9/1986 | Ostrow . | |

FOREIGN PATENT DOCUMENTS

| | | | |
|---|---|---|---|
| 0131852 | 1/1985 | European Pat. Off. | 156/542 |

*Primary Examiner*—Michael W. Ball
*Assistant Examiner*—Louis Falasco
*Attorney, Agent, or Firm*—Gordon L. Peterson; Loyal M. Hanson

[57] ABSTRACT

A label applicator includes a support structure in predetermined relationship with a labeling station at which to apply a label to an article. A label dispenser mounted on the support structure dispenses a label to be applied to the article and a receiver moveably mounted on the support structure transports the label from the dispenser to the labeling station. Receiver mounting components are provided for mounting the receiver on the support structure both to enable generally linear movement of the receiver along a path between a retracted position adjacent the dispenser and an extended position adjacent the labeling station, and to enable pivotal movement of the receiver about a pivot axis between a label-receiving position in which the label receiver can receive a label from the dispenser and a label-applying position in which the label can be transferred from the label receiver to a face of an article at the labeling station. Label retaining components releasably retain the label on the receiver so that the label can be transported by the receiver to the labeling station for application to the face of the article.

14 Claims, 5 Drawing Sheets

10
11
12
13
14
15
16
17
18
19
20
21
22
23
24
25
26
27
28
28A
29
30
31
32
33
34
35
36
37
38
39
40
41
45
46
48
49
50
52
4
5

13
52
51
50
75
11
48
47
30
36
45
63
38
37
46
39
58
56
76
30
49
34
33
35
27
28
26
25

PRINTER-TAMP LABEL APPLICATOR

It is sometimes necessary or desirable to apply a label to the forward or rear face of an article. The forward face is the face which faces forwardly in the direction of movement of the article, i.e., the leading face, and the rear face is the face which faces rearwardly. A label applicator and method for accomplishing this is described in U.S. Pat. No. 4,390,386 to Bartl.

It is sometimes necessary to print information on a label just prior to applying the label to an article. For example, the information on the label may be specific to, or apply only to, the particular article to which it applies. One example is the precise weight of the article.

In these circumstances, it is necessary to locate the printer closely adjacent to the peeler bar which is used in dispensing the label. In this event, there may be insufficient room for both the printer and a label applicator of the type disclosed in the Bartl patent. Also, it is not feasible to remotely locate the printer because the printer must print on the label immediately prior to applying the label to be sure that the correct label is applied to the correct article.

SUMMARY OF THE INVENTION

This invention solves this problem by providing a label applicator and method which can label the forward and rear faces of an article, as well as the other exposed faces of the article, and the printer can be located immediately adjacent the peeler bar. This can be accomplished by dispensing a printed label onto a label receiver and moving the label receiver along a path toward the article to be labeled, and appropriately pivoting the label receiver as the label receiver moves along the path.

The label is pivoted about a pivot axis between a label-receiving position in which the label receiver can receive a label from the dispenser and a label-applying position in which the label can be transferred from the label receiver to a face of an article at the labeling station. With this arrangement, the peeler bar and the face of the article to which the label is transferred can be in nonparallel, and even in transverse, planes. In addition, the receiver is preferably moved along a path that is inclined relative to the article face to provide a more positive retraction from the article after the label has been applied.

More particularly, the label receiver is mounted on a suitable support structure for movement in both directions between a retracted position and an extended position and for pivotal movement about a pivot axis. A label dispenser supplies at least one label to the label receiver when the label receiver is in the retracted position, and the label receiver releasably retains the label supplied to it. The label is transferred from the label receiver to the article when the label receiver is in the extended position.

According to a preferred program for movement of the label receiver, the label receiver is pivoted during only a portion of the time that the label receiver is moved along the path between the retracted and extended positions. With this arrangement, the initial movement of the label receiver occurs without pivotal movement of the label receiver so that the label receiver can clear the peeler bar.

Next, the label receiver moves along the path and pivots about a pivot axis. The pivotal movement makes the label receiving face of the label receiver and the label more parallel to the face of the article to which it is to be applied. For example, the label receiver may pivot through a relatively large acute angle.

Finally, the latter portion of the movement of the label receiver is without pivotal movement to minimize the likelihood of undesirable, premature contact of the label and the article. Similarly, during the retracting movement of the label receiver, the initial movement away from the article is without rotation to avoid unwanted contact between the label receiver and the article.

DESCRIPTION OF THE PREFERRED EMBODIMENTS

Figures 1, 2:
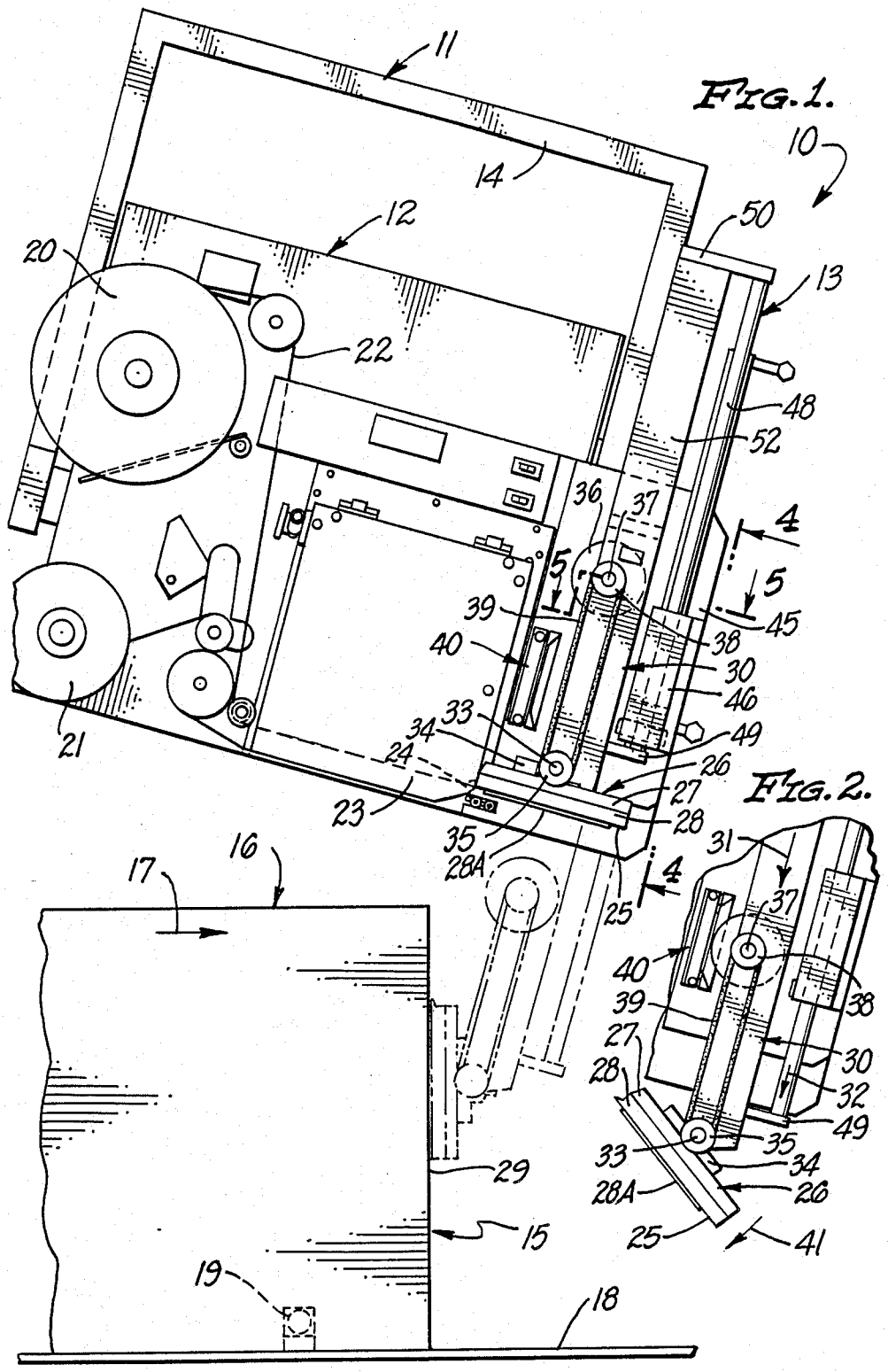
FIG. 1 of the drawings is a side elevational view of label applicator constructed according to the invention.
FIG. 2 is a detail view illustrating operation of the pivoting components.

Referring now to FIG. 1, there is shown a label applicator 10 constructed according to the invention. Generally, the label applicator 10 includes a support structure 11 on which is mounted a label dispenser 12 and applicator components or apparatus 13. The illustrated support structure 11 includes a U-arm 14 for this purpose that is adapted to be mounted on other available structure (not shown) so that the support structure 11 and the apparatus 13 are in a predetermined relationship to a labeling station 15 at which a label is to be applied to an article to be labeled, such as an article 16 (FIG. 1).

The labeling station 15 is a position to which the article 16 is moved for labeling as depicted by an arrow 17. The article 16 and other articles, may be moved for this purpose by suitable means, such as a conveyor 18. Suitable known means, such as a photodectector device 19, may be used to detect the article 16 moving into the labeling station 15, and as the article 16 is detected, an electrical signal is produced according to known techniques for use in activating the applicator 10 so that a label is applied to the article 16.

The dispenser 12 includes a storage reel 20 and a take-up reel 21. A label strip 22, such as a conventional label strip having a plurality of labels adhesively secured to a web (not individually shown), is fed from the storage reel 20 past a printer 23 and peeler bar 24 to the take-up reel 21. The printer 23 prints desired information on the label, such as article weight, and as the label passes over the peeler bar 24, it is separated from the web portion of the label strip 22 according to known techniques for doing this.

Figure 6:
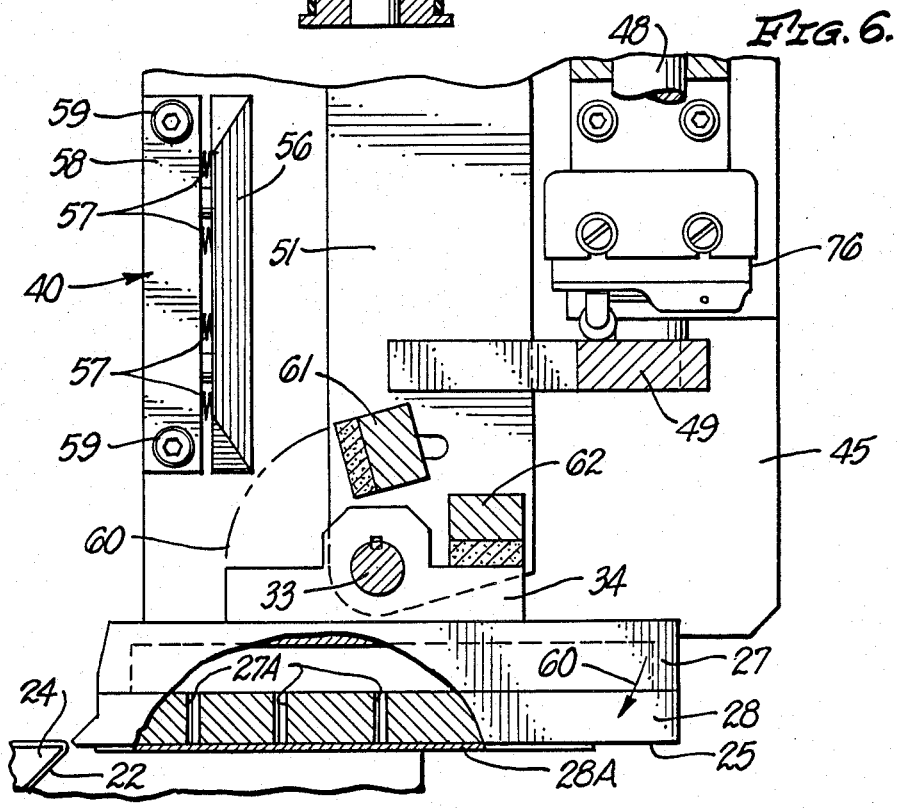
FIG. 6 is an enlarged view of the pivotal drive and stop components taken generally along line 6—6 of FIG. 4.

As the label is separated, it is dispensed onto a receiving surface 25 on a receiver 26 having a manifold 27 and a receiver head 28 that defines the receiving surface 25. The manifold 27 combines with a plurality of ports 27A in the receiver head 28 that extend to the receiving surface 25 (FIG. 6). This arrangement functions as retaining means for retaining the label on the receiver 26, as depicted by a label 28A. Vacuum pressure from a separate source (not shown) is communicated by the manifold 27 through the ports 27A, and this retains the label 28A on the receiver 26 so that the label 28A can be transported by the receiver 26 to the labeling station 15 for application to a forward face 29 of the article 16. For example, the label 28A may be transferred to the forward face 29 by a blast of air and/or by tamping the label 28A onto the face 29, with the air blast transfer being preferred.

Further details of the apparatus 13 that accomplish this are illustrated in FIGS. 1–6. The receiver 26 of the apparatus 13 is moveably mounted on the support structure 11 in the illustrated label applicator 10 in the sense that the receiver 26 is mounted on a carriage 30 that is, in turn, moveably mounted on the support structure 11. The carriage 30, and thus the receiver 26, is mounted on the support structure 11 so that the carriage 30 and the receiver 26 can be moved along a path between a retracted position of the receiver 26 adjacent the peeler bar 24 of the dispenser 12, as illustrated in solid lines in FIG. 1, and an extended position of the receiver 26 adjacent the labeling station 15 as illustrated in phantom lines in FIG. 1. Movement along the path is depicted by an arrow 31 and an arrow 32 in FIG. 2.

In addition, the receiver 26 is mounted on the carriage 30 so that the receiver 26 can be pivoted about a pivot axis defined by a pivot shaft 33 extending through and keyed to a pivot plate 34 attached to the receiver 26. The pivot shaft 33 is suitably journaled in and fixed to the carriage 30, and rotating a pulley 35 mounted on the pivot shaft 33 causes the receiver 26 to rotate accordingly. The receiver 26 can be rotated in this manner between a label-receiving position of the receiver 26 and a label-applying position of the receiver 26. In the label-receiving position, the receiving surface 25 of the receiver 26 is positioned to receive labels dispensed by the dispenser 12 and is preferably substantially aligned with the peeler bar 24 on the dispenser 12 to better enable the receiver 26 to receive a label from the dispenser 12. This position is depicted in FIG. 1 in solid lines. In the label-applying position, the receiving surface 25 is positioned to enable the label to be transferred from the receiving surface to the forward face 16 of the article 16 and is preferably aligned generally parallel with the forward face 29 of the article 16 to enable application of the label to the article 16. This position is depicted in phantom lines in FIG. 1.

The receiver 26 rotates between the label-receiving and label-applying positions as it is moved between the retracted and extended positions. This is accomplished with a movable member or V-pulley 36 affixed to a rotatable shaft 37 which is coupled by a pulley 38 and gearbelt 39 to the pulley 35. A drive member 40 engages the V-pulley 36 as the receiver 26 is moved between the retracted and extended positions, and this causes the receiver 26 to rotate about the pivot axis defined by the shaft 37 between the label-receiving and label-applying positions, as depicted by an arrow 41 in FIG. 2.

Figure 3:
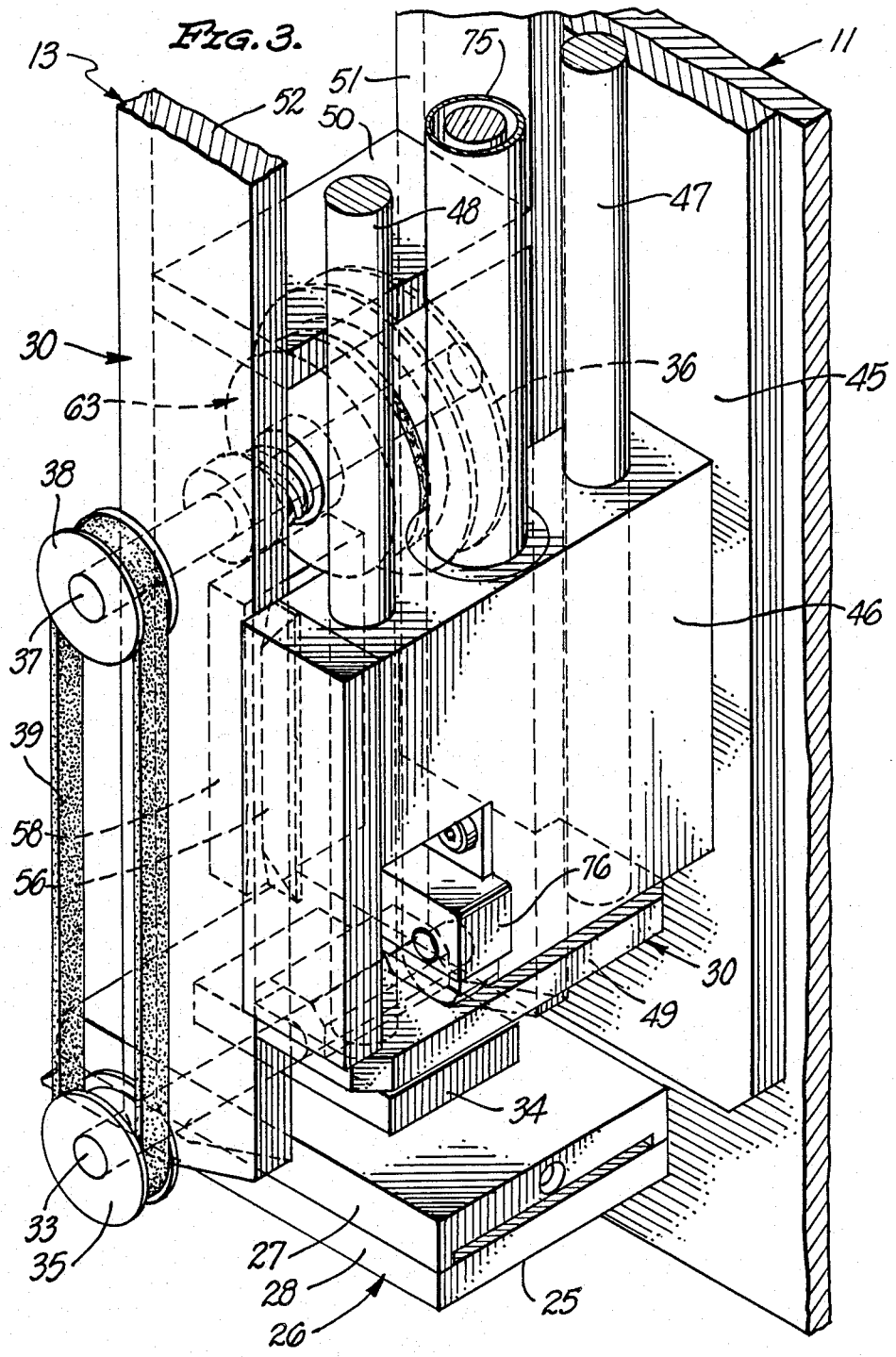
FIG. 3 is a perspective view of the label receiver and associated moving and pivoting components.
Figure 4:
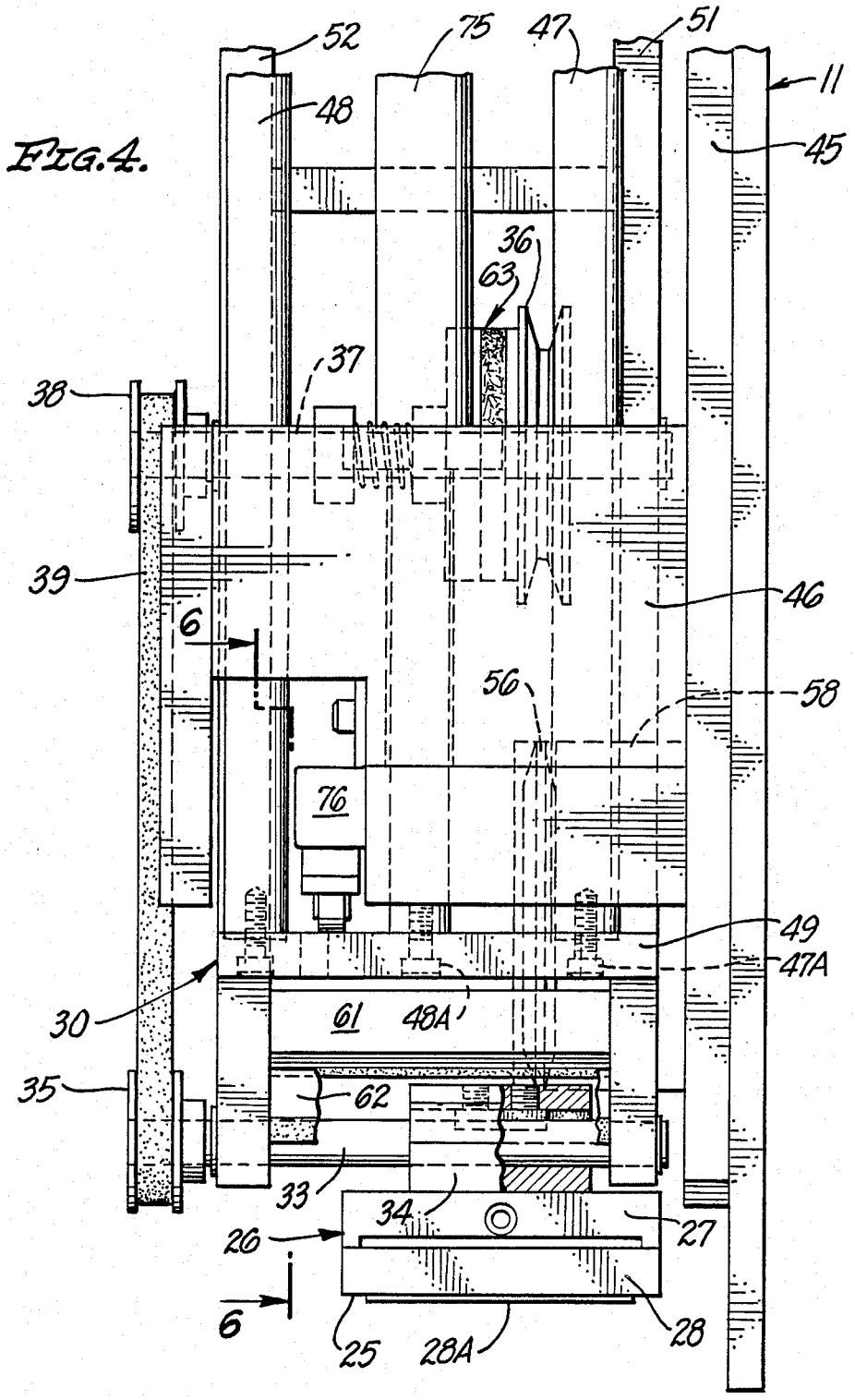
FIG. 4 is a fragmentary, front elevational view of the label receiver and associated components taken generally along line 4—4 of FIG. 1.

Further details of the apparatus 13 are shown in FIGS. 3–6. The apparatus 13 includes a faceplate 45 suitably mounted on a portion of the support structure 11, and a bearing block 46 mounted on the faceplate 45 by suitable means such as machine screws (not shown). A pair of first and second guide rods 47 and 48 pass through the bearing block 46 to a bottom support plate 49 (FIGS. 3–5) to which the guide rods 47 and 48 are attached by suitable means such as machine screws 47A and 48A (FIG. 4).

The guide rods 47 and 48 can be slid through the bearing block 46, and they combine with the bottom support plate 49, an upper support plate 50, and a pair of inner and outer support plates 51 and 52 to provide the carriage 30, which is in the form of a framework. The receiver 26 is attached to the support plates 51 and 52 by the shaft 33 which is rotatably mounted on the support plates 51 and 52. Moving the carriage 30 moves the receiver 26, and as this is done, engagement of the V-pulley 36 with the drive member 40 (FIGS. 5 and 6) causes the receiver to rotate between the label-receiving and label-applying positions.

Of course, various drive mechanisms can be employed for doing this, but the drive member 40 includes a V-drive bar 56 (FIGS. 5 and 6) mounted by a plurality of springs 57 (FIG. 6) on a mounting plate 58. The mounting plate 58 is mounted on the faceplate 45 by suitable means such as machine screws 59 (FIG. 6). As the carriage 30 is moved in the direction of an arrow 59 in FIG. 6, the V-pulley 36 passes the V-drive bar 56 which engages the V-pulley 36 and causes it to rotate. This rotational movement is transmitted by the gearbelt 39 to the shaft 33 as described above, to cause the receiver to rotate along an arc as depicted by a pair of arrows 60 in FIG. 6, the springs 57 accommodating variances in alignment of the V-pulley 36 and the V-drive bar 56.

A pair of stop members 61 and 62 (FIG. 6) are attached to the carriage 30. These serve as stop means for limiting pivotal movement of the receiver 26. The pivot plate 34 abuts the stop member 61 when the receiver is pivoted fully to the label-applying position, and the stop member 62 when pivoted fully to the label-receiving position.

A conventional slip clutch mechanism 63 (FIG. 5) allows rotational movement of the V-pulley 36 to continue in both directions, however, even when the receiver 26 is stopped. The clutch mechanism 63 includes a clutch spacer 64, a felt disc 65, and a clutch disc 66 that couple the V-pulley 36 to the shaft 37 according to known techniques. The shaft 37 passes through a bearing 67 in the inner support plate 51 and a bearing 68 in the outer support plate 52, and a collar 69, compression spring 70, and thrust bearing 71 combine conventionally for this purpose.

Figure 5:
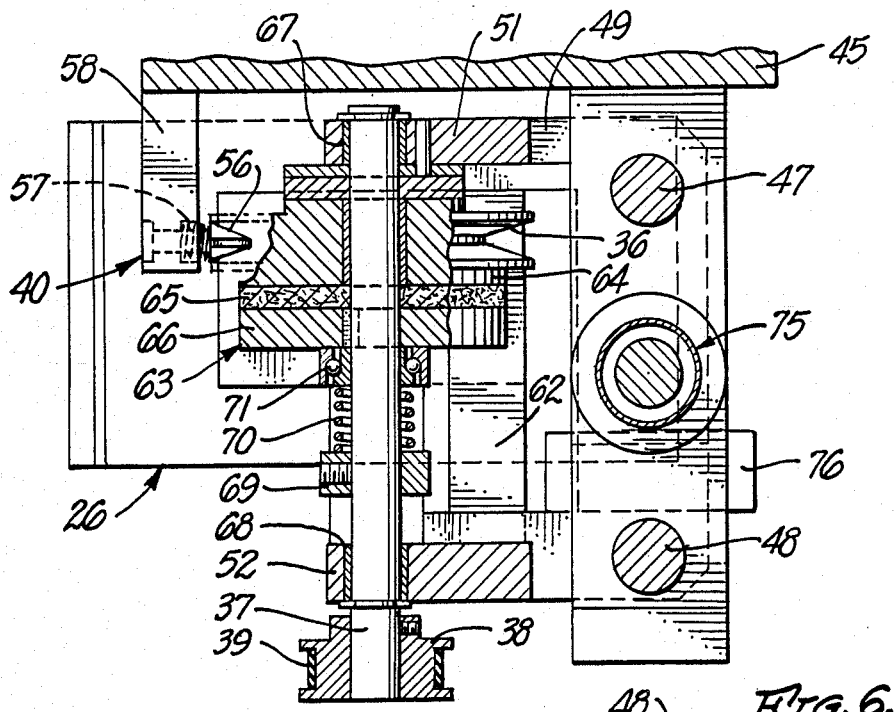
FIG. 5 is a plan view in partial cross section taken generally along line 5—5 of FIG. 1 showing further details of the clutch mechanism.

Power for moving the carriage is conventionally derived from an air cylinder 75 mounted on the bearing block 46 and drivingly coupled to the bottom support plate 49 (FIGS. 3 and 5). In addition, a microswitch device 76 (FIGS. 3 and 6), is activated upon return of the receiver 26 to the label-applying position, and it is used to activate the dispenser 12 for transfer of another label to the receiver 26.

In operation, with a label on the receiver 26, the article 16 passes the sensor 19 in moving toward the labeling station 15. The output of the sensor 19 is used to activate the carriage 30 so that it moves linearly from the retracted position illustrated in solid lines in FIG. 1 toward the extended position.

After the receiver 26 moves sufficiently toward the extended position so that it clears the peeler bar and other structure adjacent the retracted position, the receiver 26 pivots from the label-receiving position to the label-applying position. When the receiver 26 reaches the label-applying position, the pivot plate 34 abuts the stop 61, and the clutch mechanism 63 slips if necessary.

Then, with the receiver in the label-applying position, it moves the rest of the way along the inclined path toward the labeling station where it transfers the label to the forward face 19 of the article 16 by a blast of air. With the label applied, the receiver withdrawn and pivoted back to the label-receiving position in a reverse sequence to that described above, and when the microswitch device 76 is contacted, a new label is dispensed to the receiver 26.

FIGS. 7–10 show a second embodiment of the invention which is identical to the embodiment of FIGS. 1 to 6 in all respects not shown or described herein. Portions of the embodiment of FIGS. 7–10 corresponding to portions of the embodiment of FIGS. 1–6 are designated by corresponding reference numerals increased by 100.

The primary difference between the embodiment of FIGS. 7–10 and the embodiment of FIGS. 1–6 is in the means for pivoting the label receivers 26 and 126. In both embodiments, the angular position of the label receiver is controlled as a function of the position of the label receiver along the path between the extended and retracted positions. However, in the embodiment of FIGS. 7–10, the pulley 36 and the drive member 40 are replaced by a cam 181, a cam track 183, and a linkage 185 drivingly coupled to the cam and the label receiver 126.

Figure 7:
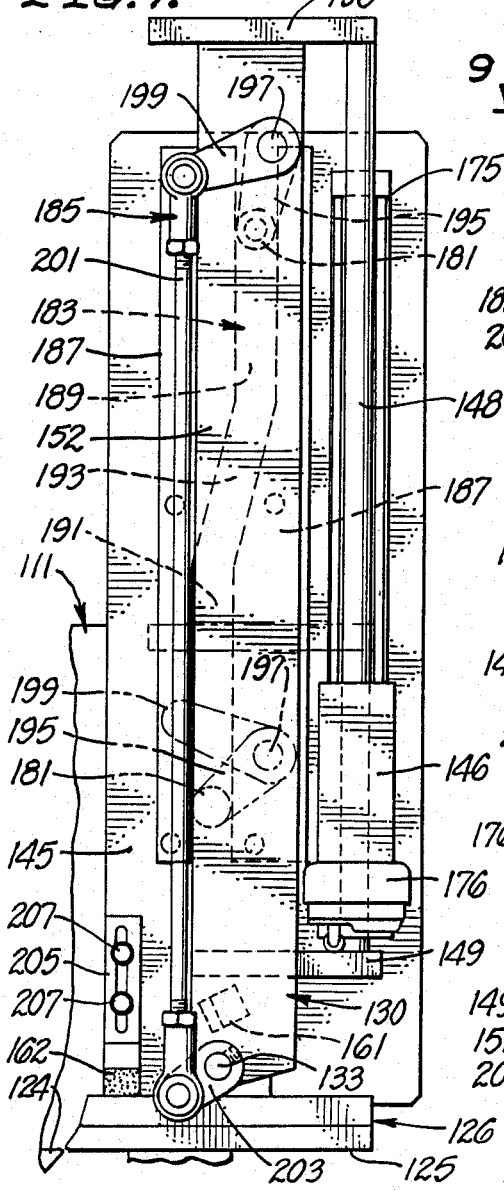
FIG. 7 is a fragmentary, side elevational view illustrating a second embodiment of the invention.
Figure 8:
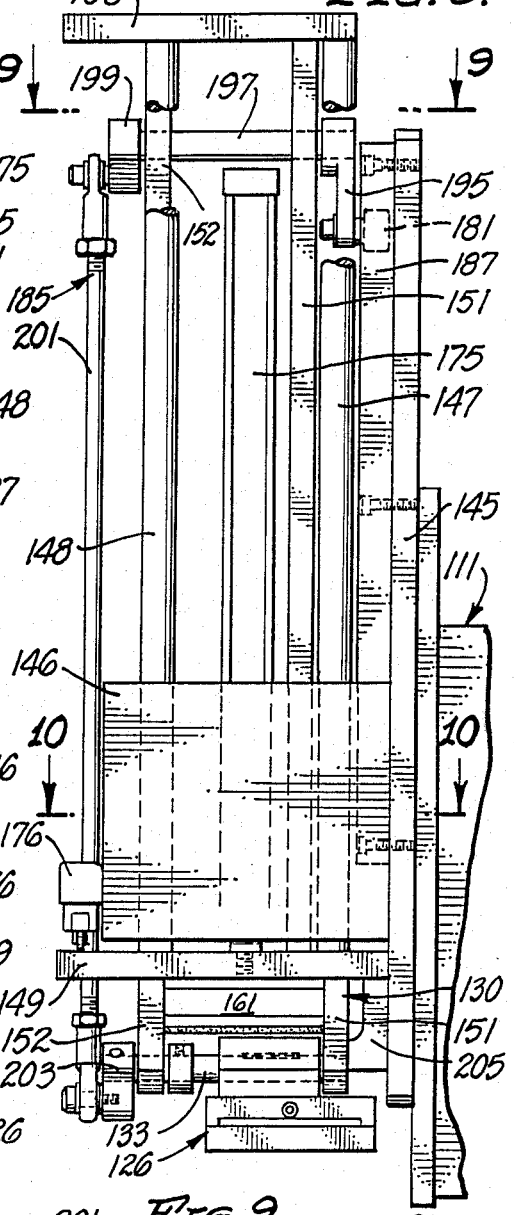
FIG. 8 is a fragmentary, front elevational view of the second embodiment.
Figure 10:
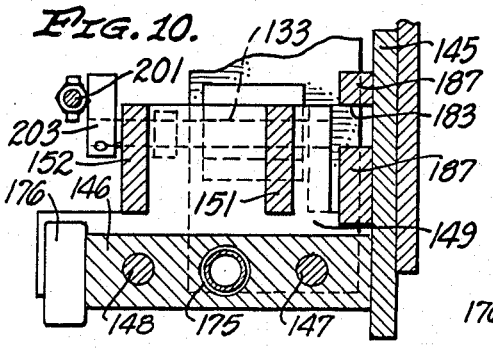
FIGS. 9 and 10 are sectional views taken generally along lines 9—9 and 10—10, respectively, of FIG. 8.
Figure 9:
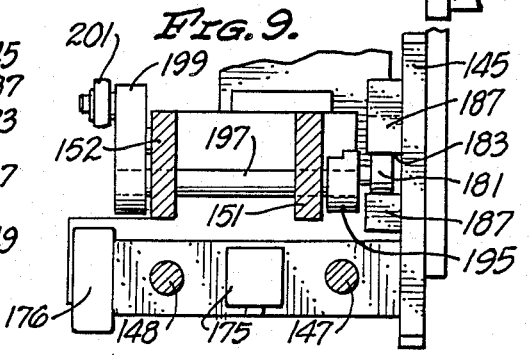

Although various constructions can be employed, in this embodiment the cam 181 is in the form of a cylindrical roller and the cam track 183 is in the form of an elongated track or groove formed by the faceplate 145 and elongated cam track members 187 (FIGS. 8–10) mounted on the faceplate. As shown in FIG. 7, the cam track 183 has linear sections 189 and 191 joined by a linear, inclined section 193 which serves to offset the linear sections 189 and 191. As explained more fully hereinbelow, pivoting movement of the label receiver 126 occurs when a cam 181 travels through the inclined section 193, and no pivoting movement of the label receiver occurs when the cam is traveling through the linear sections 189 and 191.

The linkage 185 includes a crank 195 (FIGS. 7 and 8) keyed to a shaft 197 which is rotatably mounted on the support plates 151 and 152. The linkage 185 also includes an arm 199 (FIGS. 7–9) keyed to the shaft 197 and pivotally connected adjacent its other end to an elongated link 201. An arm 203 is pivotally coupled to the other end of the link 201 and is keyed to the shaft 133 such that rotation of the arm 203 pivots the shaft and the label receiver 126.

This embodiment of the invention also employs stop members 161 and 162 for limiting the pivotal movement of the label receiver 126. The stop member 162 is carried by a slotted bracket 205 attached to the faceplate 145 by screws 207 which enable adjustment of the position of the stop member 162. The position of the stop member 161 can be similarly adjustable, if desired.

The operation of the embodiment of FIG. 7–10 is identical to the operation described above for the embodiment of FIG. 1–6. Specifically, however, as the air cylinder 175 drives the carriage 130 downwardly, the cam 181 and the linkage 185 travel with the carriage while the cam track 183 remains fixed on the faceplate 145. Of course, the cam track 183 could move with the carriage 130 and the cam 181 could be held against translation with respect to the faceplate 145, if desired because all that is necessary is appropriate relative motion between the cam and the cam track.

During the initial portion of the descent, the cam 181 moves through the linear section 189, and the components of the linkage 185 remain in the same orientation relative to each other. Consequently, no pivotal movement of the label receiver 126 occurs.

During the second portion of the descending movement of the carriage 130, the cam 181 moves through the inclined section 193 of the cam track 183, and this brings about the pivotal movement of the label receiver 126 described hereinabove with reference to the embodiment of FIGS. 1–6. By moving the cam 181 through the inclined section 193, the inclined section 193 moves the cam 181 to pivot the crank 195, the shaft 197, and the arm 199 clockwise from the position shown in full lines in FIG. 7 to the position shown in phantom lines in FIG. 7. Because the crank 195 and the arm 199 are keyed to the shaft 197, they pivot as a unit and the relative angular orientation of these two components does not change as a result of this pivotal movement. Consequently, this clockwise pivotal motion of the arm 199 raises the link 201 relative to the position that the link 201 would occupy in the absence of such rotation of the arm 199. This raising of the link 201 pivots the arm 203 clockwise as viewed in FIG. 7, and because the arm 203 is keyed to the shaft 133, the shaft 133 and the label receiver 126 pivot with the arm 203 to bring about the desired pivotal motion of the label receiver. The pivotal movement of the label receiver 126 by the linkage 185 is sufficient to bring the label receiver 126 into contact with the stop member 161.

During the third portion of descending movement of the carriage 130, the cam 181 travels through the linear section 191 and so the relative angular position of the crank 195 and the arm 199 remains as shown in phantom lines in FIG. 7 so that no pivotal motion of the label receiver 126 occurs during the period.

The dispensing of the label onto the label receiver 126 and the labeling of the article are identical to what was described in connection with the embodiment of FIGS. 1–6. Similarly, the return movement of the carriage 130 under the influence of the air cylinder 175 simply reverses the operation of the linkage 185 as the cam 181 travels along the cam track 183.

Thus, the invention solves prior art problems by providing a label applicator and method which can label the forward and rear faces of an article, as well as the other exposed faces of the article, with the printer located immediately adjacent the peeler bar. The combination of linear and pivotal movement accomplishes this in the new and improved applicator described. Although an exemplary embodiment of the invention has been shown and described, many changes, modifications, and substitutions may be made by one having ordinary skill in the art without necessarily departing from the spirit and scope of this invention.

What is claimed is:

1. A label applicator, comprising:

a support structure in predetermined relationship to a labeling station at which a label can be applied to an article;

a label receiver;

a label dispenser mounted on the support structure for dispensing a label onto the label receiver;

retaining means for releasably retaining the label on the label receiver;

receiver mounting means for mounting the label receiver on the support structure for generally linear movement along a path between a retracted position adjacent the label dispenser and an extended position adjacent the labeling station and for pivotal movement about a pivot axis between a label-receiving position in which the label receiver can receive a label from the dispenser and a label-applying position in which the label can be transferred from the label receiver to a face of an article at the labeling station;

means for pivoting the label receiver about said pivot axis as the label receiver moves along said path; and said pivot axis extending generally transverse to said path.

2. A label applicator as recited in claim 1 wherein the means for pivot includes means for initiating pivotal movement of the label receiver with the label receiver in a position intermediate the extended and retracted positions.

3. A label applicator as recited in claim 1 wherein the means for pivoting includes means for terminating pivotal movement of the label receiver with the label receiver in a position intermediate the extended and retracted positions.

4. A label applicator as recited in claim 1, wherein the receiver mounting means includes:

a carriage;

means for mounting the carriage on the support structure to enable the carriage to be moved along the path; and means for mounting the label receiver on the carriage to enable pivotal movement of the label receiver.

5. A label applicator as recited in claim 4 wherein the means for pivoting includes a movable member carried by the carriage and drivingly coupled to the label receiver; and a drive member carried by the support structure that is adapted to engage the movable member at least a portion of the time that the carriage is moved along the path to cause the label receiver to pivot.

6. A label applicator as recited in claim 4, wherein the carriage includes:

stop means for limiting pivotal movement of the label receiver.

7. A label applicator as recited in claim 5, wherein the carriage includes:

at least one stop member adapted to limit pivotal movement of the label receiver; and a slip clutch coupling the movable member to the label receiver to enable slippage when pivotal movement of the label receiver is stopped.

8. A label applicator as recited in claim 4 wherein the means for pivoting includes a movable member carried by the carriage and drivingly coupled to the label receiver; and means for imparting rotational movement to the movable member as the carriage is moved along the path to cause the label receiver to pivot.

9. A label applicator as recited in claim 1, further comprising:

a printer mounted on the support structure for printing information on the label before the label is dispensed by the dispenser.

10. A label applicator as recited in claim 1 wherein the pivoting means includes means for controlling the angular position of the label receiver as a function of the position of the label receiver along said path.

11. A label applicator as recited in claim 10, wherein:

said controlling means includes a cam and linkage drivingly coupled to the cam and the label receiver.

12. A label applicator as recited in claim 11, wherein:

the controlling means includes a cam track, said cam being movable along the cam track, one of the cam and cam track being movable along said path with the label receiver and the other of the cam and cam track being mounted on the support structure.

13. An applicator as defined in claim 1 wherein the label dispenser dispenses the label in a first direction to the label receiver and said first direction and said path are nonparallel.

14. An applicator as defined in claim 13 wherein said first direction and said path are generally transverse.

* * * * *